United States Patent [19]

Nelson et al.

[11] Patent Number: 4,975,153

[45] Date of Patent: Dec. 4, 1990

[54] PRESS SECTION APPARATUS WITH DEFLECTION COMPENSATED GRANITE ROLL SHELL

[75] Inventors: John P. Nelson; Larry O. Stafford, both of Beloit, Wis.

[73] Assignee: Beloit Corporation, Beloit, Wis.

[21] Appl. No.: 397,805

[22] Filed: Aug. 23, 1989

[51] Int. Cl.[5] ..... D21F 3/00

[52] U.S. Cl. ..... 162/358; 29/116.2; 29/130; 29/132; 162/361

[58] Field of Search ..... 162/305, 358, 360.1, 162/361; 29/116.2, 130, 132; 100/121, 153

[56] References Cited

U.S. PATENT DOCUMENTS

| | | | |
|---|---|---|---|
| 837,029 | 11/1906 | Bittner | 29/123 |
| 3,737,962 | 6/1973 | Hill | 29/123 |
| 4,047,273 | 9/1977 | Biondetti | 29/116.2 |
| 4,316,769 | 2/1982 | Dahl | 162/360.1 |
| 4,518,460 | 5/1985 | Hauser et al. | 162/358 |
| 4,642,862 | 2/1987 | Muhle et al. | 29/132 |
| 4,748,736 | 6/1988 | Miihkinen | 29/132 |

FOREIGN PATENT DOCUMENTS

| | | | |
|---|---|---|---|
| 107607 | 5/1984 | European Pat. Off. | 162/358 |
| 3632428 | 4/1988 | Fed. Rep. of Germany | 162/358 |

*Primary Examiner*—Karen M. Hastings

*Attorney, Agent, or Firm*—Dirk J. Veneman; Raymond W. Campbell; David J. Archer

[57] ABSTRACT

A press section apparatus defining a press nip is disclosed for pressing a web of paper. The apparatus includes a frame and a press member secured to the frame. A backing roll is rotatably secured to the frame with the backing roll cooperating with the press member for defining therebetween the press nip. The backing roll also includes a shaft which has a first and a second end. The ends of the shaft are secured to the frame and a shell defines a granite outer surface with the shell being disposed substantially coaxially relative to and around the shaft. The shell is rotatable relative to the shaft and a deflection compensating device compensates for relative deflection between the shell and the press member during passage of the web through the press nip.

12 Claims, 3 Drawing Sheets

PRESS SECTION APPARATUS WITH DEFLECTION COMPENSATED GRANITE ROLL SHELL

BACKGROUND OF THE INVENTION

1. Field of the Invention

The present invention relates to a press section apparatus defining a press nip for pressing a web of paper. More particularly, the present invention relates to a press section apparatus in which the backing roll includes a granite outer surface.

2. Information Disclosure Statement

Although many attempts have been made at manufacturing artificial granite press rolls, the inherent quality of granite when fabricated as a press roll is unable to be duplicated by artificial means.

More particularly, the surface texture of a granite roll is such that after passing a formed web through a press nip defined by a press member and a rotatable granite backing roll, the resultant pressed web is easily removed from the surface of the granite backing roll. However, although granite press rolls possess ideal release characteristics, they are unable to withstand bowing along the axial length thereof because unlike their counterpart steel rolls, granite backing rolls have a very low tensile strength. Therefore, according to the present invention, a granite backing roll includes deflection compensating means so that bowing of the granite roll is inhibited.

More specifically, for certain grades of paper, the desirable release characteristics exhibited by natural granite cannot be duplicated by manufactured materials. Due to the engineering strength limitations of the granite, conventional granite roll designs are not suitable for use in high nip pressure configurations which can be up to pressures of 6,000 pounds per linear inch.

A solution to the aforementioned problem is to use a granite shell or a composite shell including a metal support and an overlying sleeve of granite so that the external applied nip load is directly opposed by an internal load on the shell or sleeve to minimize bending and circumferential stresses on the granite.

The aforementioned concept has been used for metal shelled rolls in the prior art but has not been used for rolls which have a granite shell or sleeve.

The proposed granite roll would allow the application of high nip presses such as extended nip presses to grades that require granite roll surfaces for necessary sheet release characteristics.

The roll according to the present invention includes the basic deflection compensating means of a stationary center shaft which uses one or more load shoes of hydrodynamic or hydrostatic design to apply internal pressure to the inside diameter of a natural granite shell or a metallic shell or support on which a granite sleeve has been mounted.

The internal shoes or pistons are loaded by hydraulic pressure against the inside diameter of the shell in order to oppose external loads applied to the roll.

A fluid is introduced inside the roll to provide lubrication between the stationary load shoes or pistons and the rotating internal surface of the roll.

The internal hydraulic load pressure is controlled such that the load opposes the external load so that the stresses in the granite shell are kept to a minimum.

Such an arrangement allows the use of a granite roll in an externally loaded application that has not been possible with current granite roll designs.

The deflection compensating pistons can provide a uniform internal pressure along the full length in a cross-machine direction of the shell or such pistons may be segmented to provide variable pressures in either the cross-machine or the machine direction.

In one embodiment of the present invention, the granite sleeve is mounted on a metal support and end rings are used to place the granite sleeve in compression.

Since granite has very little tensile strength, it is normally put into compression so that during operation, the granite will not be subject to any tensile stresses.

Alternatively, according to another embodiment of the present invention, the backing roll includes opposing end plates with spaced holes axially drilled therethrough and a plurality of tie rods extending through corresponding spaced holes disposed axially through the granite shell so that when the tie rods are adjusted to compress the end plates, the granite shell is put into compression and is reinforced by the tie rods.

In either of the aforementioned embodiments, the backing roll may be driven or nondriven.

Therefore, a primary objective of the present invention is to provide a press section apparatus wherein a backing roll includes at least an outer surface of natural granite and deflection compensating means within the backing roll for compensating for any deflection between the shell and the press member.

Another object of the present invention is the provision of a press section apparatus which includes an extended nip press shoe and a backing roll having a granite sleeve and deflection compensating means for compensating for relative deflection between the sleeve and the shoe.

Another object of the present invention is the provision of a press section apparatus including a press member which includes a hydrodynamic shoe which cooperates with a backing roll which includes a shell defining an outer granite surface.

Another object of the present invention is the provision of a press section apparatus which includes a press member having a hydrostatic shoe wherein the backing roll includes a shell which defines a granite outer surface and a deflection compensating means for compensating for any relative deflection between the shell and the press member during passage of the web through the press nip.

Another object of the present invention is the provision of a press section apparatus including an ENP shoe and a backing roll of granite wherein the granite backing roll has deflection compensating means controlled such that during use, pressure exerted by the shoe is counteracted by a deflection compensating means and in the event of any failure in the hydraulic pressure line of the deflection compensating means, the supply of hydraulic pressure to the press shoe is simultaneously released.

Other objects and advantages of the present invention will be apparent to those skilled in the art by consideration of the detailed description and the annexed drawings.

SUMMARY OF THE INVENTION:

The present invention relates to a press section apparatus wherein the apparatus defines a press nip for pressing a web of paper. The apparatus includes a frame and a press member secured to the frame. A backing roll is rotatably secured to the frame with the backing roll cooperating with the press member for defining therebetween the press nip. The backing roll also includes a shaft which has a first and a second end. The ends of the shaft are secured to the frame and a shell defines a granite outer surface. The shell is disposed substantially coaxially relative to and around the shaft with the shell being rotatable relative to the shaft. A deflection compensating means compensates for any relative deflection between the shell and the press member during passage of the web through the press nip.

In a more specific embodiment of the present invention, the press member is a press roll.

In another embodiment of the present invention, the press member also includes a press shoe and a movable blanket which is disposed between the shoe and the granite surface such that the blanket moves with the web through the press nip.

In one embodiment of the present invention, the press shoe is a hydrodynamic shoe and in another embodiment of the invention the press shoe is a hydrostatic shoe.

In the hydrodynamic embodiment of the present invention, the press member also includes a housing which defines a cylindrical cavity. The cavity is connected to a source of pressurized fluid and a control means controls a flow of pressurized fluid to the cavity. The shoe is slidably disposed within the cavity such that when the control means is in an operative first position thereof, the shoe is urged towards the granite surface for pressing the web during passage of the web through the press nip. When the control means is in an inoperative second position thereof, a flow of the pressurized fluid to the cavity is inhibited.

In one embodiment of the present invention, a first and second bearing are disposed between the shaft and the shell with the first and second bearings being disposed adjacent to the first and second ends of the shaft respectively for rotatably supporting the shell relative to the shaft.

The shell also includes a granite sleeve which is disposed substantially coaxially relative to the shaft and around the shaft such that the web is pressed between the sleeve and the press member during passage of the web through the press nip so that deflection of the sleeve relative to the press member is compensated for. Also, a cylindrical metal support is disposed coaxially within the sleeve for supporting the sleeve.

In another embodiment of the present invention, a layer of resin binder is disposed between the sleeve and the support for bonding the granite sleeve to the support.

In a further embodiment of the present invention, the shell also includes a first and a second ring threadably cooperating with the metal support adjacent to the first and the second ends of the shaft respectively. The first and second end rings define respectively a first and second tapered face for cooperating with a first and second tapered ends respectively defined by the granite sleeve such that when the rings are threadably rotated towards each other, the sleeve is compressed and urged into close conformity with the metal support.

In another embodiment of the present invention, the backing roll also includes a first and a second end plate. The plates define a first and a second plurality of circumferentially spaced holes which extend axially through the plates respectively. A plurality of tie rods extend through the radial holes and through a further plurality of corresponding radially disposed holes extending axially through the shell such that the first and second plurality of holes and the further plurality of holes are aligned so that when the tie rods extend through the holes and are tightened, the end plates support and compress the shell which is of granite.

In one embodiment of the present invention, the deflection compensating means also includes at least one piston which is disposed between the shaft and the shell in the vicinity of the press nip. The shaft defines at least one bore for the slidable reception therein of the piston. The bore is connected to a source of pressurized fluid. Control means controls a flow of pressurized fluid into the bore such that when the control means is disposed in a first operative position thereof, the fluid flows into the bore for urging the piston along the bore towards the press member. Such compensating means compensates for deflection between the shell and the press member. When the control means is disposed in a second inoperative position thereof, the flow of fluid to the bore is cut off.

In a further modification of the present invention, the control means also controls a current of the pressurized fluid such that when the control means is disposed in a first position thereof, the shoe and the piston are urged towards each other and an equal pressure is applied within the cavity and the bore so that deflection between the shell and the press member is compensated for, and when the control means is in a second position thereof, pressure within both the cavity and the bore are simultaneously released for inhibiting any radial stress between the press member and the shell.

The present invention is not limited to the embodiments described in the detailed description or as shown in the annexed drawings. Rather, the present invention is defined by the appended claims and many modifications and variations of the present invention will be apparent to those skilled in the art by a consideration of the description of the preferred embodiment.

Included in such modifications would be the provision of a crown-compensated roll having a linear piston including a plurality of individually slidable segments. In the provision of such linear piston or pistons, such would be of generally rectangular configuration slidably disposed within corresponding rectangular-shaped linear grooves extending in a cross-machine direction.

Additionally, it will be understood by those skilled in the art that by the provision of a crown-compensated roll having diametrically opposed pistons, such pistons on one side permit application of pressure to the web extending through the pressing nip whereas the diametrically opposed pistons assist in the separation of the crown-compensated roll in order to allow changing of the felt and ancillary equipment.

BRIEF DESCRIPTION OF THE DRAWINGS:

Similar reference characters refer to similar parts throughout the various embodiments of the present invention.

Figure 1:
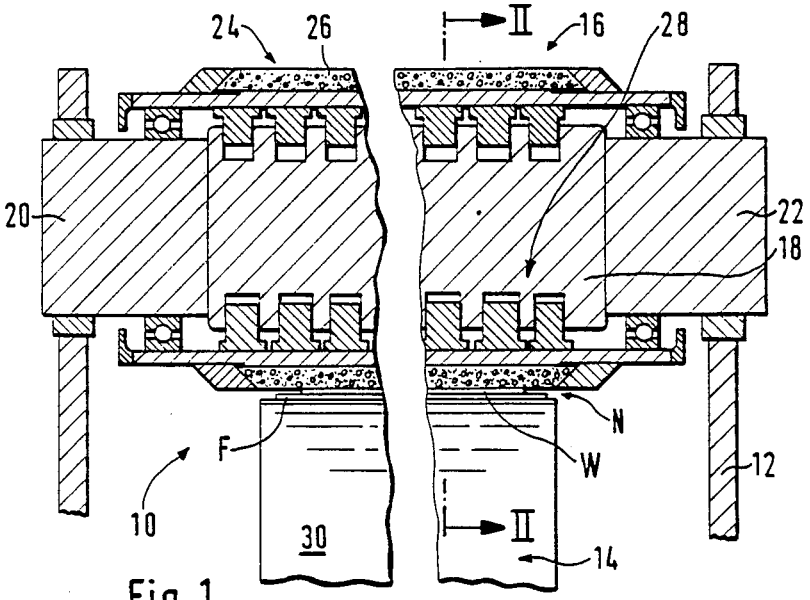
FIG. 1 is a fragmentary sectional view through the press section apparatus according to the present invention.

DETAILED DESCRIPTION OF THE DRAWINGS:

FIG. 1 is a fragmentary sectional view of a press section apparatus defining a press nip according to the present invention. The press section apparatus is generally designated 10 and the press nip N enables pressing of a web W of paper. The apparatus 10 includes a frame 12 and a press member generally designated 14 which is secured to the frame 12. A backing roll generally designated 16 is rotatably secured to the frame 12. The backing roll 16 cooperates with the press member 14 for defining therebetween the press nip N.

The backing roll 16 also includes a shaft 18 having a first and a second end 20 and 22 respectively. The ends 20 and 22 of the shaft 18 are secured to the frame 12. A shell generally designated 24 defines a granite outer surface 26. The shell 24 is disposed substantially coaxially relative to and around the shaft 18. The shell 24 is rotatable relative to the shaft 18. A deflection compensating means generally designated 28 compensates for relative deflection between the shell 24 and the press member 14 during passage of the web W through the press nip N.

Figure 2:
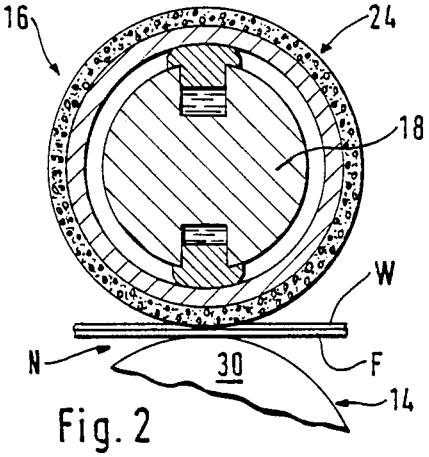
FIG. 2 is a sectional view taken on line 2—2 of FIG. 1.

In a more specific embodiment of the present invention, as shown in FIGS. 1 and 2, the press section apparatus 10 includes a press member 14 which is a press roll 30.

It will be understood that the backing roll 16 shown in FIGS. 1 and 2 is essentially a self-loading crown-compensating roll in which the lower pistons exert a pressure on the shell 24 in order to press the web W during passage through the nip N. However, the upper pistons permit separation of the backing roll 16 from the press roll 30 in order to permit changing of a felt F shown in FIGS. 1 and 2.

Figure 3:
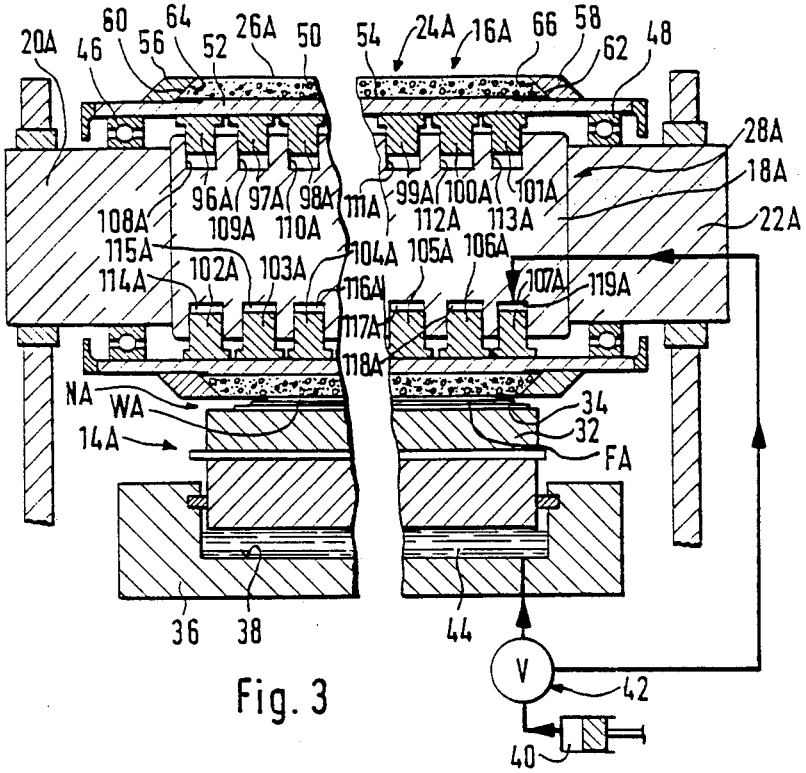
FIG. 3 is a fragmentary sectional view of an alternative embodiment of the present invention in which the press member is a hydrodynamic extended nip shoe.

In another embodiment of the present invention, as shown in FIG. 3, a press member 14A also includes a press shoe 32 and a movable blanket 34 which is disposed between the shoe 32 and the granite surface 26A such that the blanket 34 moves with the web WA through the press nip NA.

In one embodiment of the present invention, as shown in FIG. 3, the press shoe is a hydrodynamic shoe.

As shown in FIG. 3, the press member 14A also includes a housing 36 which defines a cylindrical cavity 38. The cavity 38 is connected to a source of pressurized fluid 40. Control means generally designated 42 controls a flow of the pressurized fluid 44 to the cavity 38. The shoe 32 slides relative to the cavity 38 such that when the control means 42 is in an operative first position thereof, as shown in FIG. 3, the shoe 32 is urged towards the granite surface 26A for pressing the web WA during passage of the web WA through the press nip NA. When the control means 42 is in an inoperative second position thereof, a flow of the pressurized fluid 44 to the cavity 38 is inhibited.

As shown in FIG. 3, the backing roll 16A also includes a first and second bearing 46 and 48 respectively disposed between a shaft 18A and a shell 24A. The first and second bearings 46 and 48 respectively are disposed adjacent to the first and second ends 20A and 22A of the shaft 18A respectively for rotatably supporting the shell 24A relative to the shaft 18A.

In one embodiment of the present invention, as shown in FIG. 3, a granite sleeve 50 is disposed substantially coaxially relative to the shaft 18A and around the shaft 18A. The arrangement is such that when the web WA is pressed between the sleeve 50 and the press member 14A during passage of the web WA through the press nip NA, deflection of the sleeve 50 relative to the press member 14A is compensated for.

As shown in FIG. 3, a cylindrical metal support 52 is disposed coaxially within the sleeve 50 for supporting the sleeve 50.

In one embodiment of the present invention, as shown in FIG. 3, the shell 24A also includes a layer of resin binder 54 between the sleeve 50 and the support 52 for bonding the granite sleeve 50 to the support 52.

In the embodiment of the present invention, as shown in FIG. 3, the shell 24A also includes a first and a second end ring 56 and 58 respectively. The rings 56 and 58 threadably cooperate with the metal support 52 adjacent to the first and the second ends 20A and 22A of the shaft 18A respectively. The first and second end rings 56 and 58 define respectively a first and second tapered face 60 and 62 for cooperating with a first and second tapered ends 64 and 66 respectively defined by the granite sleeve 50 such that when the rings 56 and 58 are threadably rotated towards each other, the sleeve 50 is compressed and urged into close conformity with the metal support 52.

Figure 4:
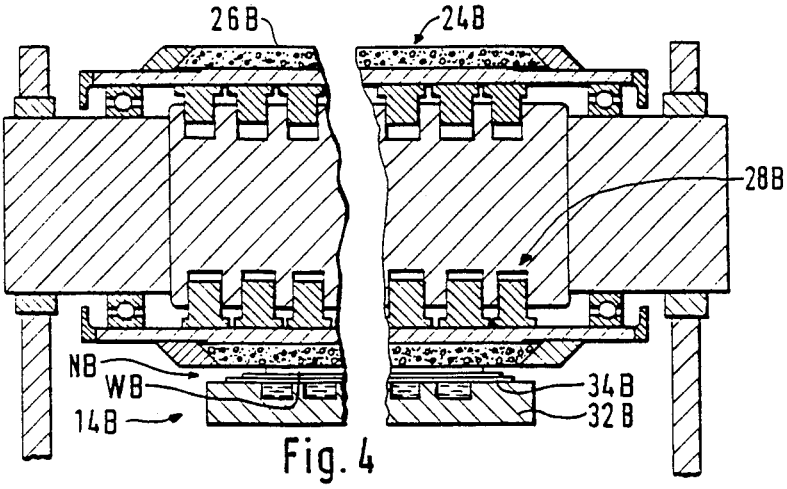
FIG. 4 is a fragmentary sectional view showing an alternative embodiment of the present invention in which the press member is a hydrostatic shoe.

In another embodiment of the present invention, as shown in FIG. 4, the press shoe is a hydrostatic shoe 32B defining a plurality of hydrostatic bearing pockets for urging the blanket 34B towards the shell 24B.

Figure 5:
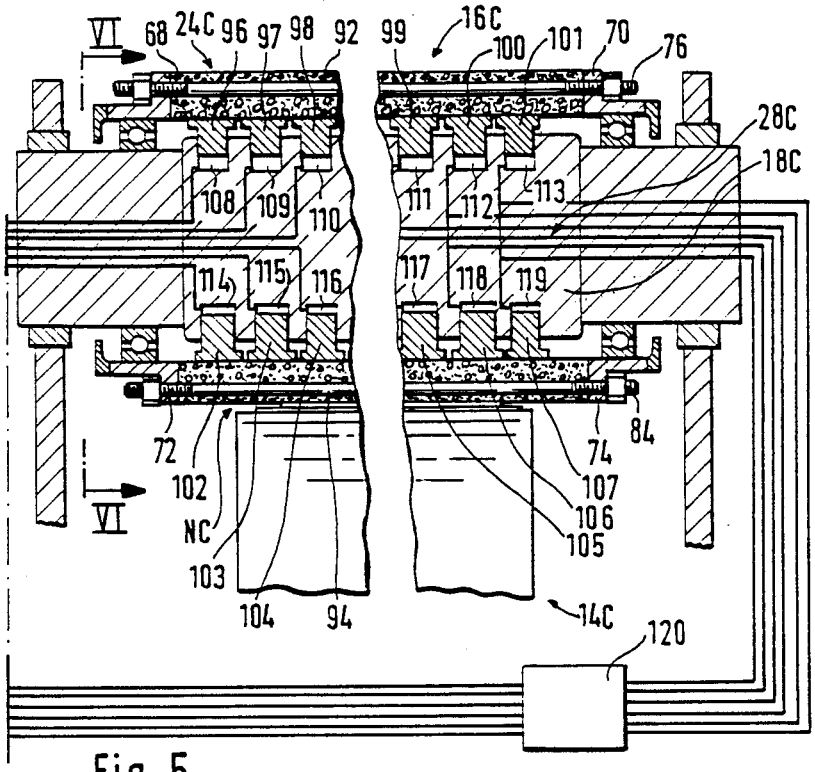
FIG. 5 is an alternative embodiment of the present invention which includes end plates and tie rods.
Figure 6:
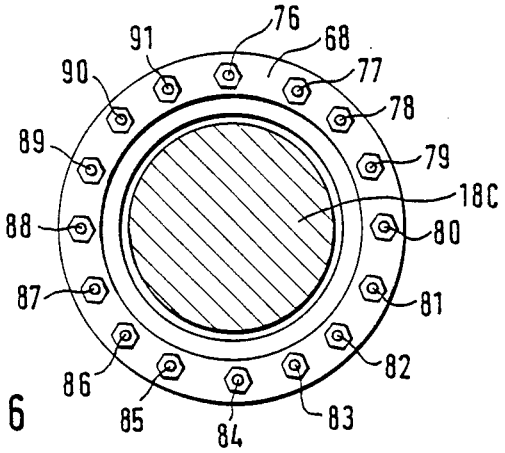
FIG. 6 is a sectional view taken on the line 6—6 of FIG. 5.

In another embodiment of the present invention, as shown in FIG. 5, the backing roll 16C also includes a first and second end plate 68 and 70. FIG. 6 is a sectional view taken on the line 6-6 of FIG. 5 and shows the plates 68 and 70 defining a first and second plurality of circumferential holes generally designated 72 and 74 which extend axially through the plates 68 and 70 respectively. Also, a plurality of tie rods 76,77,78,79,80,81,82,83,84,85,86,87,88,89,90,91 extend through the holes 72 and 74 as shown in FIG. 6. The rods 76–91 also extend through a further plurality of axial holes generally designated 92 and 94 extending axially through the shell 24C as shown in FIG. 5. The arrangement is such that the first and second plurality of holes 72 and 74 and the further plurality of holes 92 and 94 are aligned so that when the tie rods 76–91 are tightened, the end plates 68 and 70 support and compress the shell 24C which is of granite.

The deflection compensating means 28C, as shown in FIG. 5, also includes a plurality of pistons 96,97,98,99, 100,101,102,103,104,105,106,107 which are disposed between the shaft 18C and the shell 24C in the vicinity of the press nip NC. The shaft 18C defines a plurality of bores 108,109, 110,111,112,113,114,115,116,117,118,119 for the slidable reception therein of the piston 96–107. The bores 108–119 are connected to a source of pressurized fluid.

Control means 120 controls the current of pressurized fluid into the bores 114–119 such that when the control means 120 is disposed in a first operative position thereof the fluid flows selectively into the bores 114–119 for urging the pistons 102–107 along the bores 114–119 towards the press member 14C for compensating for deflection between the shell 24C and the press member 14C.

When the control means 120 is disposed in a second inoperative position thereof, the current of fluid to the bores 114–119 is cut off.

The control means 120 also enables a further current of fluid to bores 108–113 for urging pistons 96–101 upwardly to separate the crown compensating or backing roll 16C from press roll 14C.

In the embodiment of the present invention, as shown in FIG. 3, the deflection compensating means 28A also includes the control means 42 for controlling the current of pressurized fluid such that when the control means 42 is disposed in the first position thereof, the shoe 32 and the pistons 102A–107A respectively are urged towards each other and an equal pressure is applied within the cavity 38 and the bores 114A–119A so that deflection between the shell 24A and the press member 14A is compensated for. When the control means 42 is disposed in the second position thereof, pressure within both the cavity 38 and the bores is simultaneously released for inhibiting any radial stress between the press member 14A and the shell 24A.

In operation of the apparatus according to the present invention, hydraulic pressure is applied within the bores 114A–119A for compensating for pressure applied by the shoe 32 so that deflection of the granite sleeve is compensated for.

However, in the event of a sudden pressure loss within the deflection compensating means, the arrangement is such that the pressure within the press member would be simultaneously released thereby inhibiting radial stress being applied to the granite sleeve which could otherwise result in damage or fracture thereto.

In each of the foregoing embodiments, the backing roll is essentially a self-loading crown-compensating roll and the pistons therein may be linear pistons slidably disposed within corresponding rectangular-shaped grooves. Each piston has a plurality of segments in order to selectively apply pressure to the shell and for controlling the pressure applied along the cross-machine direction. The lower pistons are used to provide the necessary pressure in the pressing nip in the case of use of a plain press roll and for applying both pressure and compensating means when the press roll is replaced by an extended nip press.

The upper pistons assist in separating the crown-compensating roll upwardly away from the press roll or extended nip press permitting changing of the felt or felts.

The present invention provides a simple and inexpensive arrangement for providing a granite press roll with deflection compensating means.

What is claimed is:

1. A press section apparatus defining a press nip for pressing a web of paper, said apparatus comprising:

a frame;

a press member secured to said frame;

a backing roll rotatably secured to said frame, said backing roll cooperating with said press member for defining therebetween the press nip;

said backing roll further including:

a shaft having a first and a second end, said ends of said shaft being secured to said frame;

a shell defining a natural granite outer surface, said shell being disposed substantially coaxially relative to and around said shaft, said shell being rotatable relative to said shaft;

deflection compensating means for compensating for relative deflection between said shell and said press member during passage of the web through the press nip; and wherein said shell further includes: a natural granite sleeve defining said natural granite outer surface disposed substantially coaxially relative to said shaft and around said shaft such that the web is pressed between said sleeve and said press member during passage of the web through the press nip so that deflection of said sleeve relative to said press member is compensated for;

a cylindrical metal support disposed coaxially within said sleeve for supporting said sleeve.

2. A press section apparatus as set forth in claim 1 wherein said press member is a press roll.

3. A press section apparatus as set forth in claim 1 wherein said press member further includes:

a press shoe;

a movable blanket disposed between said shoe and said granite surface such that said blanket moves with the web through the press nip.

4. A press section apparatus as set forth in claim 3 wherein said press shoe is a hydrodynamic shoe.

5. A press section apparatus as set forth in claim 3 wherein said press shoe is a hydrostatic shoe.

6. A press section apparatus as set forth in claim 3 wherein said press member further includes:

a housing defining a cylindrical cavity, said cavity being connected to a source of pressurized fluid;

control means for controlling a flow of said pressurized fluid to said cavity, said shoe being slidable relative to said cavity such that when said control means is in an operative first position thereof, said shoe is urged towards said granite surface for pressing the web during passage of the web through the press nip and when said control means is in an inoperative second position thereof, a flow of said pressurized fluid to said cavity is inhibited.

7. A press section apparatus as set forth in claim 6 wherein said deflection compensating means further includes:

a piston disposed between said shaft and said shell in the vicinity of the press nip, said shaft defining a bore for the slidable reception therein of said piston, said bore being connected to a source of pressurized fluid;

said control means also controlling a current of said pressurized fluid such that when said control means is disposed in said first position thereof, said shoe and said piston are urged towards each other and an equal pressure is applied within said cavity and said bore so that deflection between said shell and said press member is compensated for and when said control means is in said second position thereof, pressure within both the cavity and the bore are simultaneously released for inhibiting any radial stress between said press member and said shell.

8. A press section apparatus as set forth in claim 1 wherein said backing roll further includes:

a first and second bearing disposed between said shaft and said shell, said first and second bearings being disposed adjacent to said first and second ends of said shaft respectively for rotatably supporting said shell relative to said shaft.

9. A press section apparatus as set forth in claim 1 wherein said shell further includes:

a layer of resin binder between said sleeve and said support for bonding said granite sleeve to said support.

10. A press section apparatus as set forth in claim 1 wherein said shell further includes:

a first and second end ring threadably cooperating with said metal support adjacent to said first and second ends of said shaft respectively, said first and second end rings defining respectively a first and second tapered face for cooperating with first and second tapered ends respectively defined by said granite sleeve such that when said rings are threadably rotated towards each other, said sleeve is compressed and urged into close conformity with said metal support.

11. A press section apparatus as set forth in claim 1 wherein said backing roll further includes:

a first and second end plate, said plates defining a first and second plurality of circumferentially spaced holes extending axially through said plates respectively;

a plurality of tie rods extending through said holes and through a further plurality of holes extending axially through said shell such that said first and second plurality of holes and said further plurality of holes are aligned so that when said tie rods are tightened said end plates support and compress said shell which is of granite.

12. A press section apparatus as set forth in claim 1 wherein said deflection compensating means further includes:

a piston disposed between said shaft and said shell in the vicinity of the press nip, said shaft defining a bore for the slidable reception therein of said piston, said bore being connected to a source of pressurized fluid;

control means for controlling a current of said pressurized fluid into said bore such that when said control means is disposed in a first operative position thereof, said fluid flows into said bore for urging said piston along said bore towards said press member for compensating for deflection between said shell and said press member and when said control means is disposed in a second inoperative position thereof, said current of fluid to said bore is cut off.

* * * * *